US006474357B2

(12) United States Patent
Naski

(10) Patent No.: US 6,474,357 B2
(45) Date of Patent: Nov. 5, 2002

(54) VACUUM SEWER SYSTEM

(75) Inventor: Tommi Naski, Koroistentie (FI)

(73) Assignee: Evac International Oy, Helsinki (FI)

( * ) Notice: Subject to any disclaimer, the term of this patent is extended or adjusted under 35 U.S.C. 154(b) by 0 days.

(21) Appl. No.: 09/921,213

(22) Filed: Aug. 2, 2001

(65) Prior Publication Data

US 2002/0046771 A1 Apr. 25, 2002

(30) Foreign Application Priority Data

Aug. 7, 2000 (FI) ..... 2001759

(51) Int. Cl.[7] ..... F04F 3/00

(52) U.S. Cl. ..... 137/205; 137/565.22; 137/582

(58) Field of Search ..... 137/205, 565.22, 137/582

(56) References Cited

U.S. PATENT DOCUMENTS

| | | | | |
|---|---|---|---|---|
| 4,034,421 A | | 7/1977 | Pihl et al. | 4/10 |
| 4,488,963 A | * | 12/1984 | Hellers | 137/205 |
| 5,535,770 A | | 7/1996 | Nurmi | 137/14 |

FOREIGN PATENT DOCUMENTS

| | | |
|---|---|---|
| FI | 63985 | 10/1976 |

* cited by examiner

*Primary Examiner*—Gerald A. Michalsky
(74) *Attorney, Agent, or Firm*—Marshall, Gerstein & Borun

(57) ABSTRACT

The invention relates to an arrangement in a vacuum sewer system, which comprises a sewer network having a sewage source and sewer piping adapted for receiving sewage from the sewage source. A liquid driven ejector device functions as a source of vacuum for the vacuum sewer system. In order to improve the efficiency of and to ensure the function of the ejector device, the ejector device forms a primary circuit, which is separated from a secondary circuit formed by the sewage collecting process.

17 Claims, 4 Drawing Sheets

322
342
313
304
307/344
308
304a
308a
H2
H1
332
305
346
306
328
336
338
309
310
301

VACUUM SEWER SYSTEM

FIELD OF THE INVENTION

The invention relates generally to vacuum sewer systems and, more particularly, to vacuum sewer systems having ejectors for vacuum generation.

BACKGROUND OF THE INVENTION

In vacuum sewer systems it is known to use ejector devices for generating vacuum. Such systems are disclosed, for example, in patent publications FI 63985 and EP 653524/U.S. Pat. No. 5,535,770. In these vacuum sewer systems the ejector device simultaneously provides a collecting container for the sewage coming from the sewer network. The sewage flow that is circulated by a pump from the collecting container is used as the working medium of the ejector of the ejector device. The suction side of the ejector is connected to the sewer network so that it generates partial vacuum in the sewer network, whereby the sewage coming from the sewer network flows through the ejector into the collecting container. In practice this means that the ejector discharges its working medium, that is the sewage flow circulated by the pump, together with air sucked from the sewer network and the sewage flow coming from the sewer network to the collecting container under high pressure.

Operation of the ejector causes foaming in the collecting container due to the strong jet effect, wherein the foam may be initially transferred to the surroundings through the overflow pipe of the collecting container, through the ventilation duct, and through possible leaks, and may also be transferred into the circulation process of the ejector, lessening the degree of efficiency of vacuum generation. The foaming causes problems with the sewage volume in the collecting container and with the monitoring of the sewage level in the container, which may damage the pump and lead to disturbances in the control functions of the vacuum sewer system. The behavior of the foaming sewage is subject to random changes and it may cause cavitation in the pump. The aforementioned circumstances also reduce the working life of the components of the device. Furthermore, the opening of the device, for example in connection with maintenance or repair, causes a discharge of dangerous gases.

SUMMARY OF THE INVENTION

The object of the present invention is to avoid the above mentioned disadvantages and to achieve an arrangement that has a simple structure and a reliable function. Accordingly, a vacuum sewer system is provided for transporting sewage. The system comprises a sewer network including a sewage source and sewer piping adapted to receive sewage from the sewage source. A liquid driven ejector device creates a partial vacuum pressure and includes a primary circuit for circulating liquid functioning as a working medium through the ejector device. The sewer network defines a secondary circuit for transporting waste, and the primary circuit and said secondary circuit are separated from each other.

In accordance with additional aspects of the present invention, an ejector device is provided for generating vacuum in a vacuum sewer system having a sewer network with a sewage source and sewer piping adapted to receive sewage from the sewage source, wherein the sewer network defines a sewage path. The ejector device comprises an ejector container, an ejector having a suction side, and means for circulating a liquid functioning as a working medium of the ejector. A suction connection is connected to the suction side of the ejector and adapted for fluid communication with the sewer network. The ejector container, ejector, and circulating means define a circulation circuit for the working medium for the ejector device, and the circulation circuit is separated from the sewage path.

DESCRIPTION OF THE PREFERRED EMBODIMENTS

Figure 1:
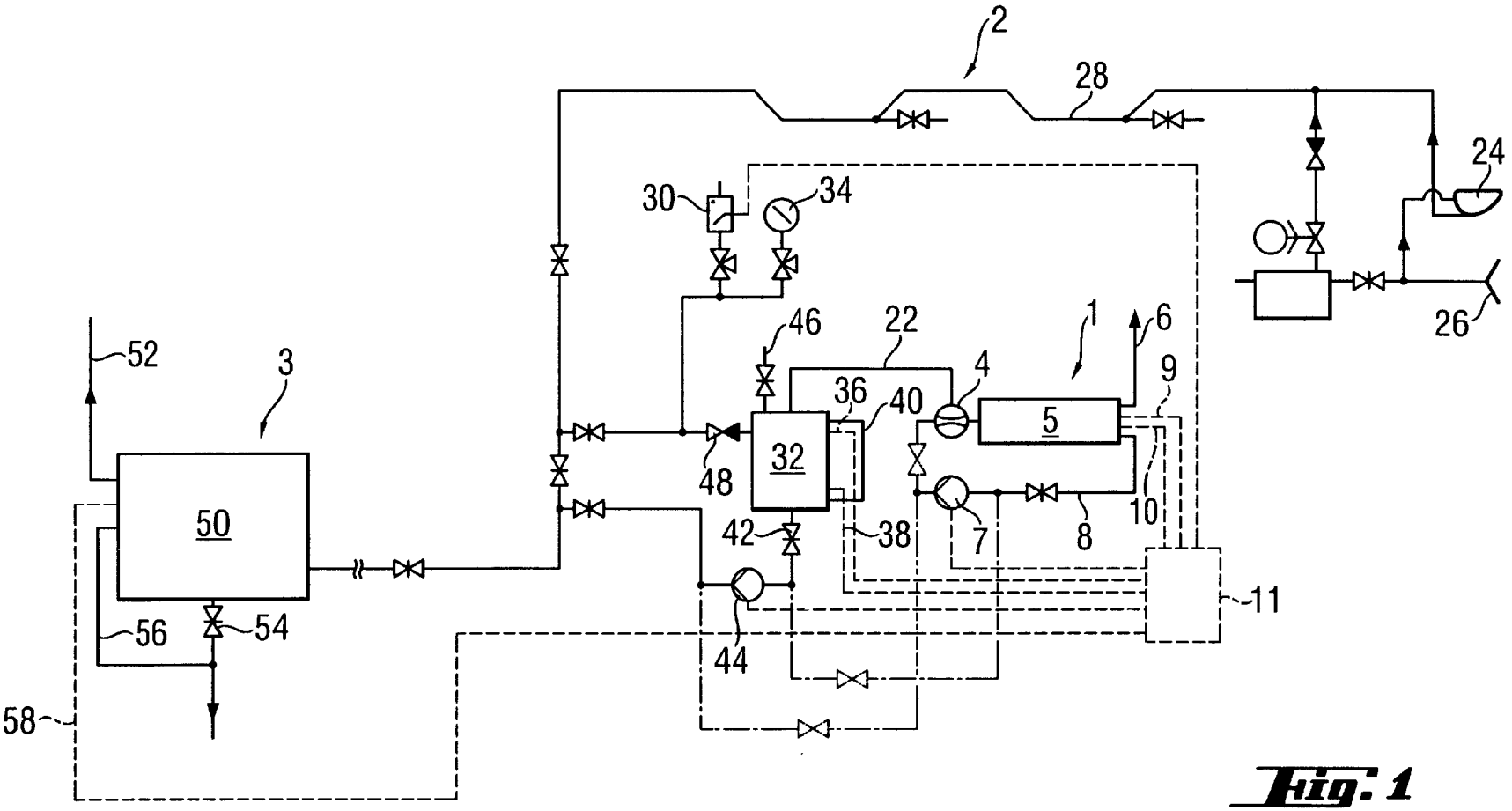
FIG. 1 shows a schematic diagram of a vacuum sewer system in accordance with the teachings of the present invention.

In the vacuum sewer system shown in FIG. 1, an ejector device, generally indicated by reference numeral 1, is connected to a sewer network 2 attached to a storage container 3, which may be used to circulate, treat, or discharge the sewage coming from the sewer network.

The ejector device 1 comprises an ejector 4 with a suction connection connected to the sewer network 2. The ejector device 1 also includes an ejector container 5 maintained under substantially normal atmospheric pressure through a ventilation pipe 6, and circulation means, such as a circulation pump 7, which is preferably a centrifugal pump. A volume of liquid is maintained in the ejector container 5, wherein the liquid level is monitored by sensor means 9 and 10 connected to a control center 11 for monitoring the surface level of the liquid. Liquid is sucked through the liquid transport pipe 8 from the ejector container 5 by the circulation pump 7 and supplied to the ejector 4, which discharges the liquid with high pressure back into the ejector container 5. Air is drawn in a manner known per se from the sewer network 2 through the suction pipe 22 by the ejector 4, i.e. through its suction connection connected to the sewer network 2. This procedure provides a vacuum in the sewer network that is generally in the range of about −0.3 to −0.7 bar and preferably in the range of about −0.4 to −0.6 bar.

The liquid functioning as the working medium of the ejector 4 is preferably water which may be treated with chemicals to reduce the harmful effects from the sewage in the sewer network 2. Water is an economical and environmentally friendly substance, and may be easily treated so that the harmful effects of contamination, i.e. the corrosive effects on the ejector device 1 and any undesirable odors from the sewage or from the gases developing from it, may be easily neutralized.

The circulation process of the ejector generates a partial vacuum pressure, and therefore is substantially closed, except for the suction connection connected to the sewer network 2, to form a primary circuit. The primary circuit is separated from a secondary circuit formed by the vacuum sewer system, which is used to collect sewage. As a result, the volume of liquid required for vacuum generation in the primary circuit is minimized. When substantially clean water is used as the liquid working medium, for example, its circulation and discharge does not cause foaming or any other factors that disturb the function of the ejector device. When one ejector 4 is used, the supply of liquid may be as small as approximately 100 liters, while there is no upper limit to the liquid volume that may be used. More than one ejector, however, may be provided, and the number of ejectors can be chosen according to the need for vacuum generation in the sewer network on a case by case basis. Furthermore, the liquid may be something other than water, as long as the liquid is chosen so that the above-mentioned objectives are attained.

The secondary circuit of the vacuum sewer system (i.e. the sewage collecting process) mainly comprises the sewer network 2, the storage container 3, and an intermediate collecting container 32 arranged before the storage container 3.

The sewer network 2 according to the given example may comprise one or more sources of sewage, although FIG. 1 shows only a vacuum toilet 24 and a source of flush water 26 connected thereto. Sewage from a vacuum toilet unit is usually categorized as black water. Furthermore, the sewer network may comprise for example wash basins, showers, etc., which are not shown in FIG. 1 and from which the above mentioned grey water originates. The vacuum toilet unit 24 is connected to sewer piping, such as vacuum piping 28, through a valve means. From the vacuum toilet unit 24 the vacuum piping 28 leads to the intermediate container 32.

As has been described above, a vacuum of a certain magnitude is generated in the sewer network 2 by the ejector device 1. In the embodiment of FIG. 1, the vacuum is provided through the suction connection connected to the suction side of the ejector 4 and through the pipe 22 directly to the intermediate container 32, in order to provide for transportation of the sewage from the vacuum toilet unit 24 through the vacuum piping 28 to the intermediate container 32. The vacuum piping 28 is provided with a pressure transducer 30 and/or pressure gauge 34 connected to the control center 11 for monitoring the pressure level in the vacuum piping 28 and the intermediate container 32. The intermediate container 32 is preferably provided with sensor means 36, 38 connected to the control center 11 for monitoring the sewage surface level in the intermediate container and may further be provided with an observation window 40. The intermediate container 32 in the described vacuum sewer system functions as temporary container and is provided with emptying means, which comprise a discharge valve 42, and discharge means 44, for example a circulation pump, which is preferably a centrifugal pump.

In so far as the circulation means for the liquid functioning as the working medium of the ejector 4 and the emptying means for the intermediate container 32 both comprise a centrifugal pump, these can easily be cross-coupled so that one can be used instead of the other according to need, such as in the event of damage or maintenance.

In connection with the emptying of the intermediate container 32, the intermediate container is placed under substantially normal atmospheric pressure, for example through a ventilation pipe 46, whereby the valve 48 in the vacuum piping 28 is closed. The collecting container 32 is emptied through the discharge valve 42 by the circulation pump 44 to a discharge space, such as sewage container 50 having a ventilation pipe 52, which is also under substantially normal atmospheric pressure. The sewage container 50 may further be provided with emptying means, which in the illustrated embodiment include a discharge valve 54 and an overflow guard 56. The amount of sewage collected in the sewage container 50 is monitored by a sensor means 58 connected to the control center 11 for monitoring the surface level of the sewage. Alternatively, the intermediate container 32 may also be arranged to be emptied into a free discharge space, to a sewage treatment plant or into another selected space depending on the type of sewage in question and in which connection the vacuum sewer system is applied.

Figure 2:
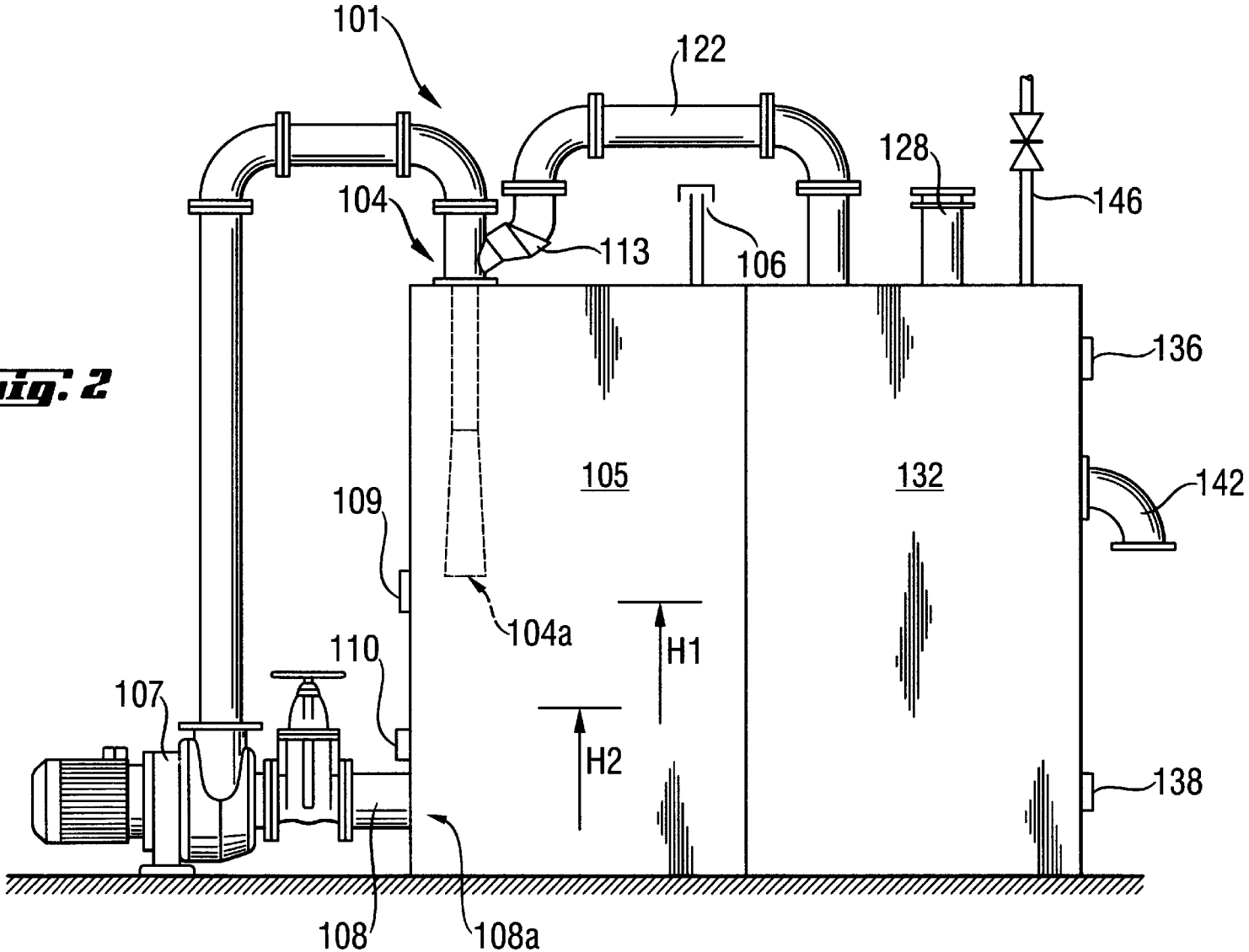
FIG. 2 shows a first embodiment of an ejector device and a collecting container for use in the vacuum sewer system of FIG. 1.

In FIG. 2 is shown a first embodiment of an ejector device 101 and a sewage collecting container 132, which may be used in the above disclosed vacuum sewer system. The ejector device 101 comprises a centrifugal pump 107 having a suction side connected to a working medium transport pipe 108, which in turn is connected to the lower part of the ejector container 105, the container 105 being maintained under substantially normal atmospheric pressure. The centrifugal pump 107 circulates the liquid, which functions as the working medium for the ejector 104, by pulling the liquid from the ejector container 105 and feeding it with high pressure through the ejector 104 back into the ejector container 105. In this way the ejector 104, in a manner known per se, draws air through a suction pipe 122 in communication with a suction connection 113 connected to the suction side of the ejector 104. The suction pipe 122 is connected to the sewage collecting container 132 so that a partial vacuum is created in the collecting container 132 and vacuum piping 128 of the sewer network. The ejector container 105 is provided with a ventilation pipe 106.

In this embodiment the ejector container 105 of the ejector device and the sewage collecting container 132 are formed of two adjacent, vertically arranged containers. The ejector 104 is arranged in the upper part of the ejector container 105 so that it discharges the liquid from its discharge opening 104*a* downwards, from the upper part of the ejector container 105 towards its lower part. A volume of liquid is maintained in the ejector container 105, and sensor means 109, 110 are provided for monitoring the liquid surface level. The maximum height H1 of the liquid surface level is preferably kept below the discharge opening 104*a* of the ejector 104 and the minimum height H2 above the inlet opening 108*a* of the liquid transfer pipe 108, which forms the liquid inlet of the centrifugal pump 107. As a result, the transfer of liquid from the ejector container 105 to the circulation pump 107 is undisturbed, to maximize the efficiency of the ejector 104.

The ejector device can also be arranged so that the ejector is positioned at the lower part of the ejector container, whereby the ejector discharges the liquid upwards towards the upper part of the ejector container. Also in an arrangement of this type the above given surface level limits are valid.

The primary circuit formed by the ejector device 101 is substantially closed, except for the suction connection. The liquid functioning as the working medium is preferably water that has been blended with appropriate chemicals to neutralize the gases developed by the sewage collected in the collecting container 132, so that the ejector device is not harmed. The sewage collecting container 132 is provided with a ventilation pipe 146, an emptying valve 142, and sensor means 136, 138 for monitoring the surface level of the sewage.

Figure 3:
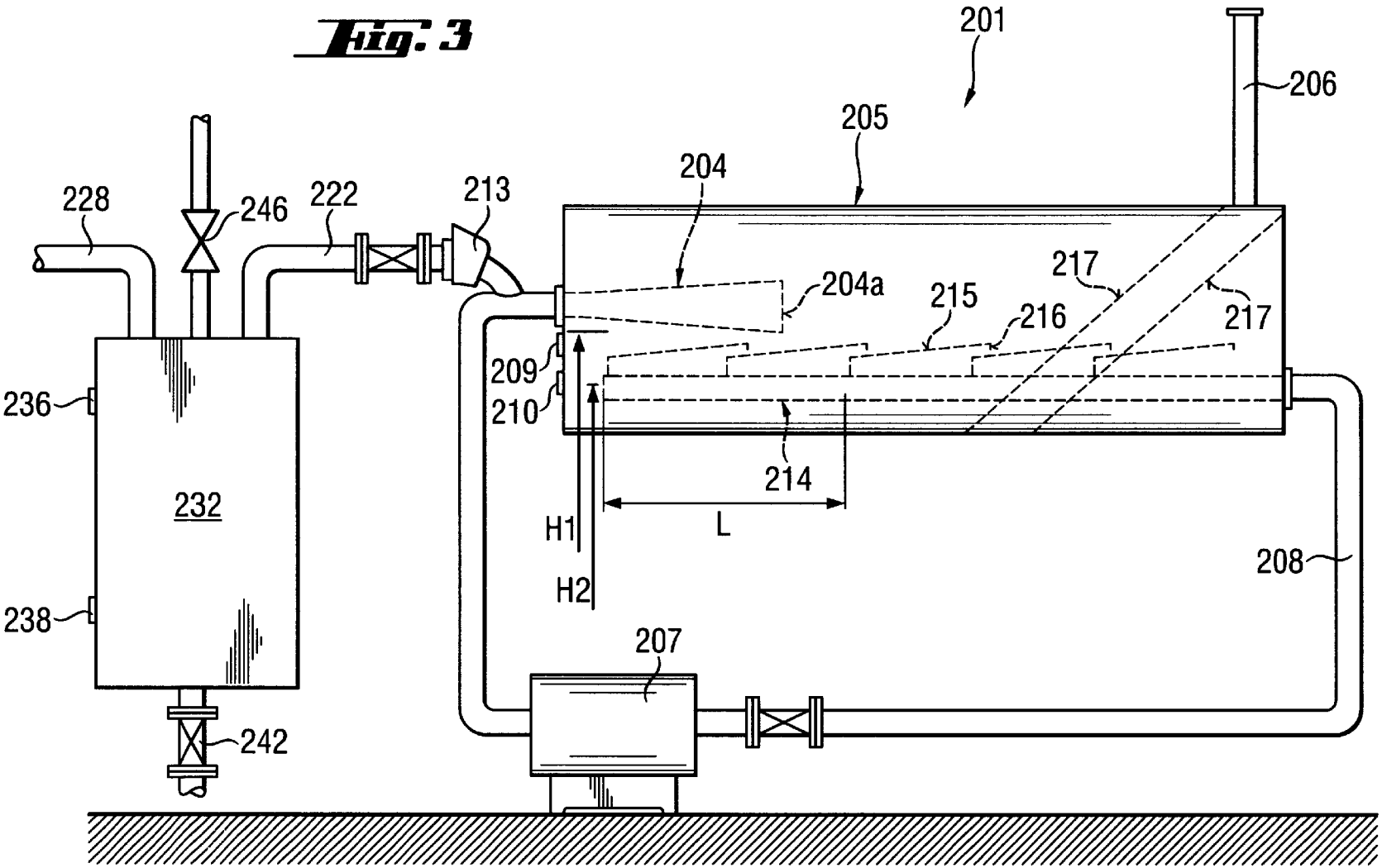
FIG. 3 shows a second embodiment of an ejector device and a collecting container.

FIG. 3 illustrates a second embodiment of the ejector device and the collecting container, which may be used in the above disclosed vacuum sewer system. The ejector device 201 comprises a centrifugal pump 207 having a suction side connected to a working medium transfer pipe 208, which, in turn, is connected to the lower part of the ejector container 205. The centrifugal pump 207 circulates liquid by pulling liquid from the ejector container 205, in which the liquid is maintained at substantially normal atmospheric pressure, and forcing the liquid at high pressure through the ejector 204 back into the ejector container 205. The ejector container 205 is provided with a ventilation pipe 206. As a result, the ejector 204 pulls air from the sewage collecting container 232 through the suction connection 213 connected to its suction side in a known manner to create a partial vacuum in the collecting container 232 and the vacuum piping 228 of the sewer network. From FIG. 3, it will be appreciated that the ejector device 201 and the collecting container 232 are arranged separate from each other in this embodiment.

The primary circuit formed by the ejector device 201 is substantially closed, with the exception of the suction pipe connection. The liquid functioning as the working medium is preferably water blended with appropriate chemicals to neutralize gases formed by the sewage collected in the collecting container 232, thereby to prevent damage to the ejector device.

The sewage collecting container 232, which is shown vertically arranged, is provided with sensor means 236, 238 for monitoring the surface level of the sewage collected in the collecting container, as well as with a discharge valve 242 and a ventilation pipe 246.

The ejector container 205 has a substantially longitudinal configuration with a cylindrical cross-section and is horizontally arranged, whereby the ejector 204 discharges the liquid from its discharge opening 204*a* in the longitudinal direction of the ejector container 205. The liquid transfer pipe 208 connected to the suction side of the centrifugal pump 207 passes through an end of the container 205 opposite the ejector 204, and runs along a lower edge of the ejector container 205 so that an end of the pipe 208 is positioned near the ejector end of the ejector container 205. The liquid is drawn into the transfer pipe 208 from a suction slot 214 on its underside, which forms the inlet of the centrifugal pump 207 and which extends to a distance L from the ejector end of the transfer pipe 208 towards the opposite end. The suction slot 214 is preferably at its broadest at the ejector end of the transfer pipe 208 and narrows in the other direction, i.e. in the suction direction. This has shown to be an advantageous arrangement for ensuring that only liquid, and no air, is sucked into the centrifugal pump forced through the ejector. Any additional air could disturb the functioning of the arrangement.

The minimum height H2 of the liquid surface level in the ejector container 205 is kept above the transfer pipe 208 which forms the inlet of the working medium of the centrifugal pump 207, and at least above the suction slot 214 of the transfer pipe 208, while the maximum level H1 is kept below the discharge opening 204*a* of the ejector 204. The ejector container 205 is provided with sensor means 209, 210 for monitoring the liquid surface level.

The liquid, as it exits the ejector 204 at high pressure, may generate significant splashing in the ejector container 205, which may lead to the formation of air bubbles in the liquid. In addition to the arrangement of the above described liquid transfer pipe 208 comprising its suction slot 214, it has shown to be advantageous that a dampening structure 215, 216 be provided above the transfer pipe 208 to reduce the splashing of the liquid. Such a structure may, for example, be formed by overlapping wings 215 opening away from the ejector 204, which receive the liquid flow deflecting from the end of the ejector container 205 opposite the ejector 204. The wings 215 preferably extend over the entire width of the ejector container 205 and they may also be provided with downward extending front edges 216, which in turn stop the liquid flow returning from the wings. In this manner a steady and turbulence-free function of the centrifugal pump 207 and the ejector 204, respectively, may be ensured.

The ejector container 205 may further be provided with separation means 217, shown by broken lines, in order to separate air from the water. The separation means 217 in this example are perforated plates 217 arranged at the end of the ejector container 205 opposite the ejector 204. The perforated plates 217 are preferably arranged in an inclined position, for example at an angle of approximately 45° with respect to the longitudinal direction of the ejector container 205.

Figure 4:
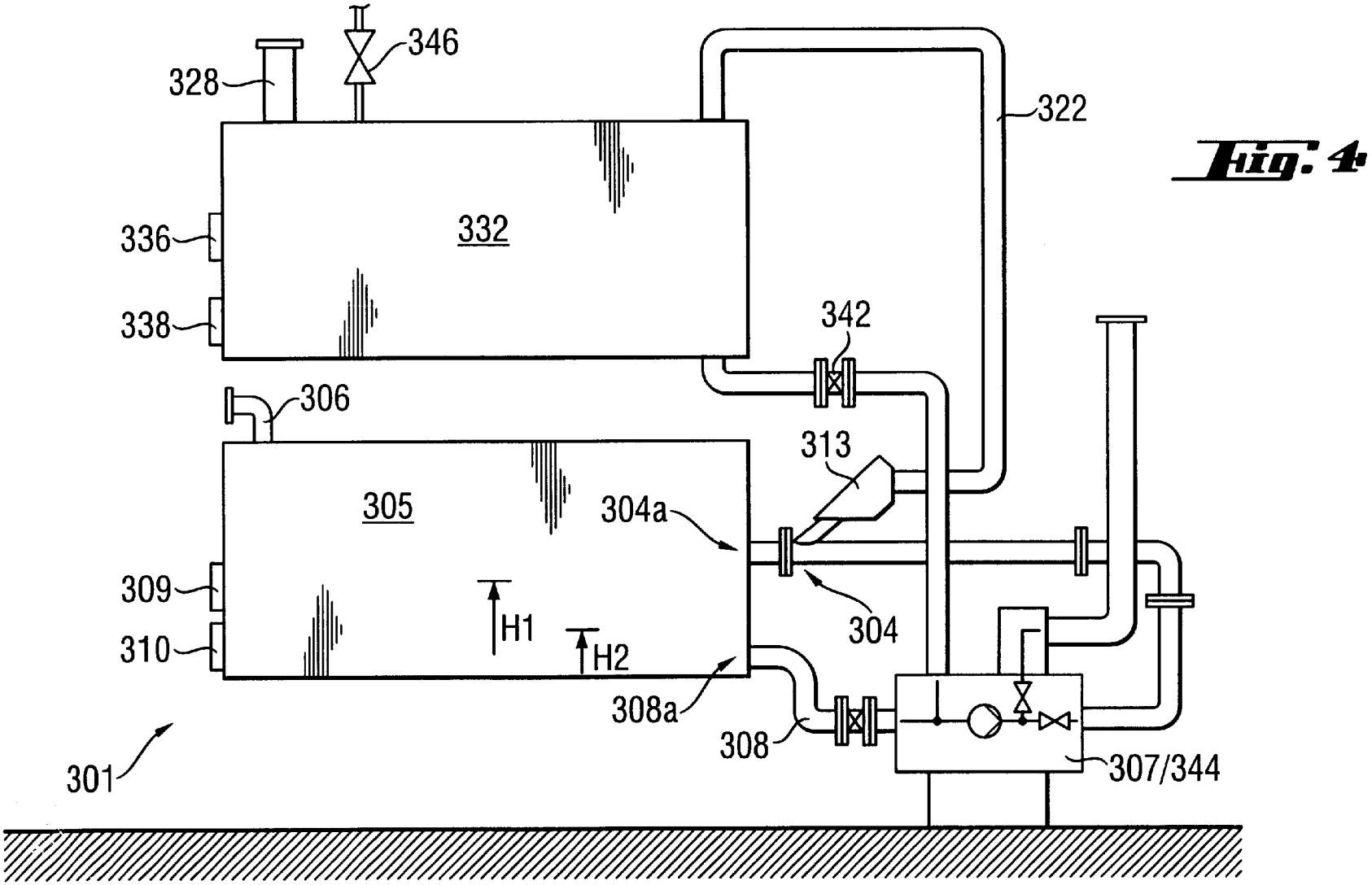
FIG. 4 shows a third embodiment of an ejector device and a collecting container.

FIG. 4 illustrates a third embodiment of the ejector device and the sewage collecting container, which may be used in the above disclosed vacuum sewer system. The ejector device 301 comprises a centrifugal pump 307 having a suction side connected to a working medium transfer pipe 308, the pipe 308 being connected to the lower part of the ejector container 305, that is maintained under substantially normal atmospheric pressure. The centrifugal pump 307 circulates the liquid working medium by pulling the liquid from the ejector container 305 and forcing the liquid through the ejector 304 under high pressure back into the ejector container 305. In this way the ejector 304 pulls air from the sewage collecting container 332 through the suction pipe 213 in a known manner to create a vacuum in the collecting container 332 and the vacuum piping 328 of the sewer network. The ejector container 305 is also provided with a ventilation pipe 306.

In this embodiment, the ejector container 305 of the ejector device and the sewage collecting container 332 are formed into two containers arranged one on top of the other and in a horizontal direction.

The primary circuit formed by the ejector device 301 is substantially closed, with exception of the suction pipe. The liquid functioning as the working medium is preferably water blended with appropriate chemicals to neutralize the gases formed by the sewage collected in the collecting container 332, thereby to prevent damage to the ejector device. The sewage collecting container 332 is provided with a ventilation pipe 346, a discharge valve 342, and sensor means 336, 338 for monitoring the surface level of the sewage.

In the horizontal ejector container 305*c*, the ejector 304 is arranged to discharge liquid from its discharge opening 304*a* in the longitudinal direction of the ejector container 305. The minimum height H2 of the surface level of the liquid in the ejector container 305 is kept above the inlet opening 308*a* of the transfer pipe 308, which forms the liquid working medium inlet of the centrifugal pump 307, and the maximum height H1 is kept below the discharge opening 304*a* of the ejector 304. The ejector container 305 is provided with sensor means 309 and 310 for monitoring the surface level of the liquid.

This embodiment provides an example of having the same centrifugal pump used both as the circulation means 307 for the working medium of the ejector 304 as well as the discharge means 344 of the sewage collecting container 332.

The above described dampening structure and the perforated plates used for avoiding splashing and formation of air bubbles are examples of how to avoid air being transferred into the circulation means for the working medium of the ejector 204, comprising a centrifugal pump 207. Such means increase the degree of efficiency of vacuum generation and ensure an appropriate function of the centrifugal pump. These arrangements can be used together or separately. Corresponding structures can, if so desired, also be applied in connection with the embodiments shown in FIGS. 2 and 4.

The above described three embodiments are only examples of possible applications of the invention. The objective is that the liquid circuit of the ejector device is closed, i.e. separate from the sewage collecting process, that the amount of liquid is kept as small as possible, that the state of the liquid is stabilized after discharge from the ejector, so that it is transferred to the circulation means in a stabile state without air bubbles etc., and that the size of the ejector device is kept as small as possible.

In connection with these three embodiments separate pumps may be used as the circulation means for the ejector device and as the discharge means for the sewage collecting container, as described in connection with FIG. 1, or the same pump, as described in connection with FIG. 4. Instead of the centrifugal pump mentioned, any other suitable pump or device suitable for the purpose may be used as a circulation means for the ejector device and as the discharge means for the sewage collecting container.

From the foregoing, it will be appreciated that a liquid driven ejector is used in the vacuum sewer system, the circulation process of which is kept compact and without disturbances, and that the sewage collecting process is kept substantially separate from the circulation process of the ejector device so that the sewage and its treatment do not directly have an effect on the vacuum generation in the sewer system, i.e. on the ejector device. The vacuum generation provided by the ejector device may form a primary circuit and the sewage collecting process a secondary circuit.

The main components of the ejector device advantageously include a container, in which substantially normal atmospheric pressure prevails, an ejector, circulation means for the liquid functioning as a working medium of the ejector and a suction connection connected to suction side of the ejector, which suction connection is connected to the sewer network.

On the sewage collecting process side of the vacuum sewer system, a collecting container, to which the suction connection of the ejector device is connected, may also be connected to the sewer network. The circulation means of the liquid, which functions as a working medium of the ejector, may include a circulation pump, preferably a centrifugal pump. The liquid working medium may be water, which has been treated for neutralizing the harmful effects of the sewage and the gases formed therefrom.

The ejector container may be provided with sensor means connected to a control center for monitoring the surface level of the liquid working medium of the ejector. In this way a stable and efficient functioning of the circulation means and the ejector may be ensured. In order to ensure the functioning of the sewage collecting process, i.e. the secondary circuit, the sewage collecting container may be provided with emptying means and sensor means for monitoring the surface level of the sewage. The emptying means for the collecting container may include a circulation pump, preferably a centrifugal pump.

By using separate but similar means for the ejector device circulation means and the collecting container emptying means, these may be cross-coupled so that they are alternatively usable when one is out of order due to, for example, damage, maintenance, or replacement. Alternatively the same means may be used as the circulation means for the ejector device and as the emptying means for the collecting container to reduce costs, which may be particularly advantageous for smaller vacuum sewer systems.

The sewage collecting container may be provided as an intermediate container, in which case the vacuum sewer system may further include a sewage container for storing the sewage for a desired time. The sewage collecting process may cover the transfer of sewage from the source of sewage to the sewer network and the transport of sewage to a possible circulation, treatment, storage or other discharge space via an intermediate collecting container.

The sewage may comprise grey water, such as waste water and/or solid waste from a wash room, and black water, such as waste water and/or solid waste from a toilet unit. The vacuum sewer system may also be used in connection with supermarkets or corresponding sites, which may generate different types of sewage. The sewage generated in a supermarket may include grey water from, for example, waste from meat or fish treatment utilities, which is typically first transferred to a treatment plant before its further transport. Furthermore, condensate from refrigerators or freezers may be generated, which, if so desired, may be recirculated for use as flush water in a toilet unit, for example.

Although certain exemplary apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A vacuum sewer system for transporting sewage, the system comprising:

a sewer network including a sewage source and sewer piping adapted to receive sewage from the sewage source; and a liquid driven ejector device for creating a partial vacuum pressure, the ejector device including a primary circuit for circulating liquid functioning as a working medium through the ejector device;

wherein the sewer network defines a secondary circuit for transporting waste; and wherein the primary circuit and said secondary circuit are separated from each other.

2. The vacuum sewer system of claim 1, in which the ejector device comprises an ejector container maintained under substantially normal atmospheric pressure, an ejector having a suction side, means for circulating the liquid working medium, and a suction connection connected to the suction side of the ejector and to the sewer network.

3. The vacuum sewer system of claim 2, in which the sewer network comprises a sewage collecting container in fluid communication with the suction connection of the ejector device.

4. The vacuum sewer system of claim 3, in which the sewage collecting container is provided with emptying means and a sensor connected to a control center for monitoring a surface height of the sewage.

5. The vacuum sewer system of claim 4, in which the emptying means for the sewage collecting container comprise a circulation pump.

6. The vacuum sewer system of claim 5, in which the sewage collecting container comprises an intermediate container and in which the vacuum sewer system further comprises a sewage container for storing the sewage.

7. The vacuum sewer system of claim 4, in which the circulation means for the working medium of the ejector and the emptying means for the collecting container comprise separate means, and in which the circulation means for the working medium of the ejector and the emptying means for the collecting container are cross-coupled.

8. The vacuum sewer system of claim 4, in which the circulation means for the working medium of the ejector and the emptying means for the collecting container comprise the same means.

9. The vacuum sewer system of claim 2, in which the circulation means for the working medium of the ejector comprises a circulation pump.

10. The vacuum sewer system of claim 9, in which the liquid working medium comprises water treated to neutralize the sewage.

11. The vacuum sewer system of claim 2, in which the ejector container is provided with sensor means connected to a control center for monitoring a surface level of the liquid working medium.

12. An ejector device for generating vacuum in a vacuum sewer system having a sewer network with a sewage source and sewer piping adapted to receive sewage from the sewage source, the sewer network defining a sewage path, the ejector device comprising:

an ejector container;

an ejector having a suction side;

means for circulating a liquid functioning as a working medium of the ejector; and a suction connection connected to the suction side of the ejector and adapted for fluid communication with the sewer network;

wherein the ejector container, ejector, and circulating means define a circulation circuit for the working medium for the ejector device, and the circulation circuit is separated from the sewage path.

13. The ejector device of claim 12, in which the ejector container is arranged substantially vertically.

14. The ejector device of claim 12, in which the ejector container is arranged substantially horizontally.

15. The ejector device of claim 12, in which the ejector container is provided with sensor means for monitoring a surface level of the working medium for the ejector and in which the surface level of the working medium in the ejector container is maintained below an outlet opening of the ejector and above an inlet opening of the circulation means.

16. The ejector device of claim 12, in which the ejector container is provided with a structure for dampening movement of the working medium.

17. The ejector device of claim 12, in which the ejector container is provided with separation means.

* * * * *